US009849052B2

(12) United States Patent
Stevens et al.

(10) Patent No.: US 9,849,052 B2
(45) Date of Patent: Dec. 26, 2017

(54) PRESSURE RELIEVING MATTRESS

(75) Inventors: Leyton Stevens, Bridgend (GB); Ian Mahoney, Caerau (GB)

(73) Assignee: INVACARE UK OPERATIONS LIMITED, Pencoed (GB)

( * ) Notice: Subject to any disclaimer, the term of this patent is extended or adjusted under 35 U.S.C. 154(b) by 577 days.

(21) Appl. No.: 14/238,981

(22) PCT Filed: Aug. 14, 2012

(86) PCT No.: PCT/GB2012/051977

§ 371 (c)(1),
(2), (4) Date: Jun. 4, 2014

(87) PCT Pub. No.: WO2013/024281

PCT Pub. Date: Feb. 21, 2013

(65) Prior Publication Data

US 2014/0317855 A1 Oct. 30, 2014

(30) Foreign Application Priority Data

Aug. 16, 2011 (GB) ..... 1114081.1

(51) Int. Cl.
*A61G 7/057* (2006.01)

(52) U.S. Cl.
CPC ..... *A61G 7/05769* (2013.01); *A61G 7/05776* (2013.01)

(58) Field of Classification Search
CPC ..... A61G 7/05707; A61G 7/05723; A61G 7/05769; A61G 7/05776
See application file for complete search history.

(56) References Cited

U.S. PATENT DOCUMENTS 3,678,520 A * 7/1972 Evans ..... A61G 7/05776 297/284.1
3,909,858 A * 10/1975 Ducker ..... A47C 27/081 5/713
4,193,149 A * 3/1980 Welch ..... A61G 7/05776 5/713
4,638,519 A * 1/1987 Hess ..... A61G 7/002 5/53.3
4,896,389 A * 1/1990 Chamberland .... A61G 7/05769 5/710

(Continued)

FOREIGN PATENT DOCUMENTS

EP 2 047 832 A2 4/2009
EP 2 070 503 A1 6/2009
WO 2010/052389 A1 5/2010

OTHER PUBLICATIONS

International Search Report and Written Opinion dated Jan. 30, 2013 in connection with PCT/GB2012/051977.

*Primary Examiner* — David E Sosnowski
*Assistant Examiner* — Ifeolu Adeboyejo
(74) *Attorney, Agent, or Firm* — Quarles & Brady LLP

(57) ABSTRACT

This invention relates to a pressure relieving mattress including an elongate support 11 having a base 12, a pressure relieving overlay 15 and an inflatable inlay 16. The inlay 16 has a plurality of laterally extending inflatable cells 23. At least some of the cells, in at least their un-inflated state, have an inflatable volume which is wider adjacent its ends than its mid portion. This reduces the likelihood of gaps appearing between the pressure overlay and the walls of the tray.

12 Claims, 5 Drawing Sheets

(56) References Cited

U.S. PATENT DOCUMENTS 5,235,713 A * 8/1993 Guthrie ..... A61G 7/05769 5/411
5,243,721 A * 9/1993 Teasdale ..... A61G 7/05776 5/710
5,267,364 A * 12/1993 Volk ..... A61G 7/05776 5/710
5,369,828 A * 12/1994 Graebe ..... A47C 4/54 297/452.41
5,394,577 A * 3/1995 James ..... A61G 7/05776 5/713
5,560,057 A * 10/1996 Madsen ..... A61G 7/001 5/710
5,584,085 A * 12/1996 Banko ..... A61G 7/05776 5/710
5,634,225 A * 6/1997 Miller, Sr. ..... A61G 7/05776 5/710
5,774,917 A * 7/1998 Liu ..... A61G 7/001 5/609
5,787,531 A * 8/1998 Pepe ..... A47C 27/10 5/710
5,963,997 A * 10/1999 Hagopian ..... A61G 7/05776 5/654
6,223,369 B1 * 5/2001 Maier ..... A61G 7/05707 5/706
6,370,716 B1 * 4/2002 Wilkinson ..... A61G 5/1043 297/314
6,591,437 B1 * 7/2003 Phillips ..... A61G 7/05769 5/706
6,671,912 B1 * 1/2004 Tsai ..... A61G 7/05776 5/710
6,813,790 B2 * 11/2004 Flick ..... A47C 27/082 5/710
6,942,687 B1 * 9/2005 Heaton ..... A61F 7/10 607/107
7,913,338 B2 * 3/2011 Chapman ..... A61G 7/05776 5/655.3
2004/0128772 A1 * 7/2004 Branson ..... A61G 7/05776 5/713
2007/0186349 A1 * 8/2007 Lipman ..... A47C 27/084 5/713
2008/0028534 A1 * 2/2008 Wilkinson ..... A47C 27/083 5/713
2008/0155755 A1 * 7/2008 Crousore ..... A61G 7/015 5/706
2008/0201858 A1 * 8/2008 Caminade ..... A61G 7/05776 5/713
2009/0100605 A1 * 4/2009 Caminade ..... A61G 7/05776 5/713
2009/0144903 A1 * 6/2009 Delvaux ..... A61H 31/008 5/617
2010/0089411 A1 * 4/2010 Porter, III ..... A61G 7/05776 128/889
2010/0180384 A1 * 7/2010 Balonick ..... A47C 27/082 5/709
2012/0227186 A1 * 9/2012 Pile ..... A61G 7/05776 5/710
2012/0297540 A1 * 11/2012 Thomas ..... A61G 7/0507 5/424

* cited by examiner

PRESSURE RELIEVING MATTRESS

CROSS-REFERENCE TO RELATED APPLICATIONS

This application represents the national stage entry of PCT international Application No. PCT/GB2012/051977 filed Aug. 14, 2012, which claims priority to Great Britain Patent Application 1114081.1 filed Aug. 16, 2011, the disclosures of which are hereby incorporated by reference in their entirety for all purposes.

This invention relates to pressure relieving mattresses. For many years the main two types of pressure relieving mattresses consisted of a foam mattress with a pressure relieving upper surface or having a pressure relieving overlay, or an inflatable air mattress. Air mattresses enable the patient to be supported in different places at different times by inflating and deflating different portions of the air mattress and their use is important to reduce or prevent bed sores in patients who have to lie relatively immobile in bed. They are, however, expensive, require substantial pumps due to their large air volume and can take a long time to inflate for first use, thereby making any bed switch over slow and problematic. Pressure relieving foam mattresses are used as standard mattresses in most hospital beds but when they become inadequate for a particular patient, for the reason set out above, the change over to an air mattress is time consuming and slow and the bulky foam mattress then has to be stored somewhere in the ward or hospital.

For this reason hybrid mattresses have been developed. Most typically they consist of a tray of relatively rigid foam, a pressure relieving overlay and an inflatable inlay located between the overlay and the base of the tray. Accordingly when the variable support of an air mattress is required, a pump simply needs to be attached to the inlets of the inlay and very quickly, with minimum fuss, an 'air mattress' function can be achieved. The inlay does not have to provide the full depth of the mattress, as is usual with a typical air mattress, and so its volume is significantly lower, with the result that it can be inflated more quickly. It will be understood that an expensive pump is not needed for each mattress. The ward simply has some available which can be used over the full extent of the ward in accordance with patient's requirements. Smaller pumps also tend to be less bulky and quieter. Such a mattress is sold by Invacare under the trade mark Soft Form Premier Active. These mattresses have been clinically and commercially very successful but users have reported a tendency for the mattresses to bow near the sides, despite the provision of the firmer side edges of the tray like base.

From one aspect the invention consists in a pressure relieving mattress including an elongate support having a base, pressure relieving overlay and an inflatable inlay having a plurality of laterally extending inflatable cells characterised in that at least some of the cells, in at least their un-inflated state, have an inflatable volume which is wider adjacent its ends than in its mid portion.

Thus preferably the at least some cells having a narrow mid portion in an un-inflated state but which, when inflated, together define a substantially horizontal support platform. Preferably the un-inflated volumes of at least some cells are in the shape of a bow tie when un-inflated.

The Applicants have determined that, somewhat surprisingly, by providing wider ends in the un-inflated state, inflated cells do not tend to bow at their ends but rather, in their inflated state, tend to provide a substantially horizontal support for the patient. This support may commonly not be continuous, because desirably the cells are arranged in two sets consisting of alternate cells and the inlay is inflated on a cyclical basis so that as one set of cells is inflated, the other set is deflating.

From another aspect the invention consists in a pressure relieving mattress including an elongate support having a base and pair of spaced longitudinal side walls the base providing a base surface extending between the side walls; a pressure relieving overlay overlying the base surface; and an inflatable inlay extending between the base surface and the overlay and having a plurality of laterally extending inflatable cells supplied by a supply extending longitudinally along the mattress characterised in that the base is recessed to allow the supply to lie below the base surface.

Preferably there are two separate supplies for supplying alternate elements or alternate groups of elements and each supply lies in a or the recess. In some embodiments there may be a recess for each supply.

In a particularly preferred construction part of each supply lies on the opposite side of the overlay, in which case that part will also lie in a recess. Thus conveniently there are recesses on opposite sides of the base.

The location of the supply or supplies in a recess or recesses means that the elements can extend across the full width of the base surface. In former designs the supplies run along the top of the base surface, reducing the available dimensions for the cells and it has been found that, surprisingly, the resultant gaps between the ends of the cells and the side walls of the base contribute to the bowing of the mattress, when the inlay is inflated.

In some embodiments the or each element may have an anchor flap for encircling a supply to secure the element. This has at least two advantages. Firstly it removes the need for a separate tie system, as exists on current hybrid mattresses, often leading to additional thickness of the inlay at the centre, and also it provides the possibility of being able to replace individual elements in the case of a puncture or other failure.

Thus the anchored flaps may have an associated passage for allowing air to pass from the supply to the element or to allow air to pass from the element to the supply. In any of these cases the mattress may further include ties for securing the or each supply to the support this may be achieved by attaching the ties to selected elements and, in particular their anchor flaps.

At least one of the supplies may be made up of modular elements, which may include T portions, connectors and elbow connectors. The modular nature enables various configurations of elements to be made up and allows for easy repair of any part of the supply becomes damaged. An arm of at least some of the T portions may engage in the passage of a respective element.

In any of these cases at least some of the cells may be wider adjacent their ends. These at least some cells may have a narrower intermediate portion, which when inflated together defines substantially horizontal support platform. The at least some cells may be in the shape of a bow tie when un-inflated.

From another aspect the invention consists in a pressure relieving mattress including a base, an air supply extending along the base and an inflatable element connected to the supply for inflation characterised in that the inflatable element includes an anchor flap for encircling the supply.

From yet another embodiment the invention consists in the pressure relieving mattress including a base, an overlay and an inflatable inlay located between the base and the overlay wherein the inflatable portion of the inlay is substantially the same width as the overlay.

Although the invention has been defined above it is to be understood it includes any inventive combination of the features set out above or in the following description. The invention may be performed in various ways and specific embodiments will now be described, by way of example with reference to the accompanying drawings, in which.

Figure 1:
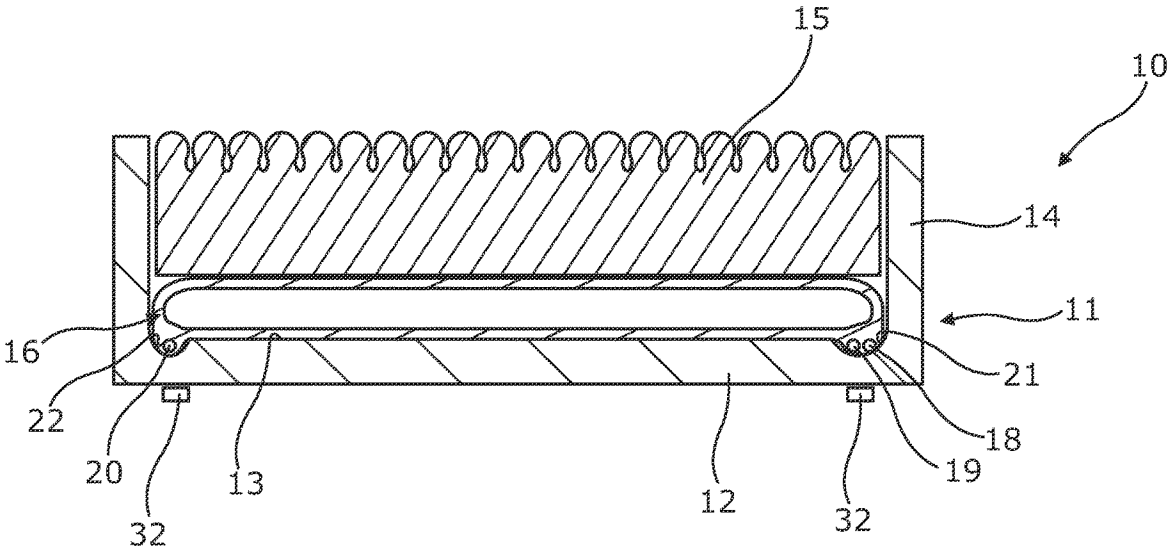
FIG. 1 is a vertical section through a hybrid pressure relieving mattress.
Figure 2:
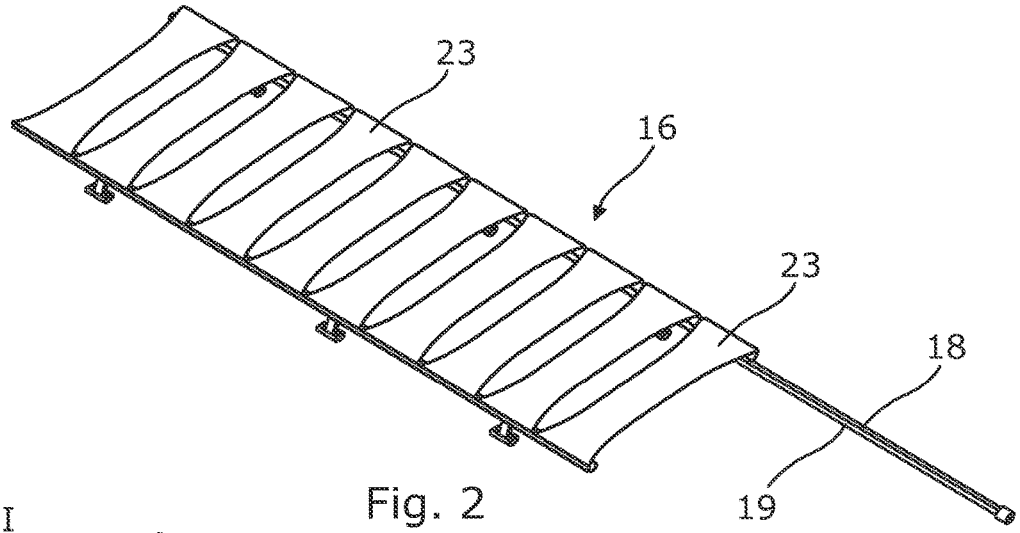
FIG. 2 is a vie from above of an inflatable inlay.
Figure 3:
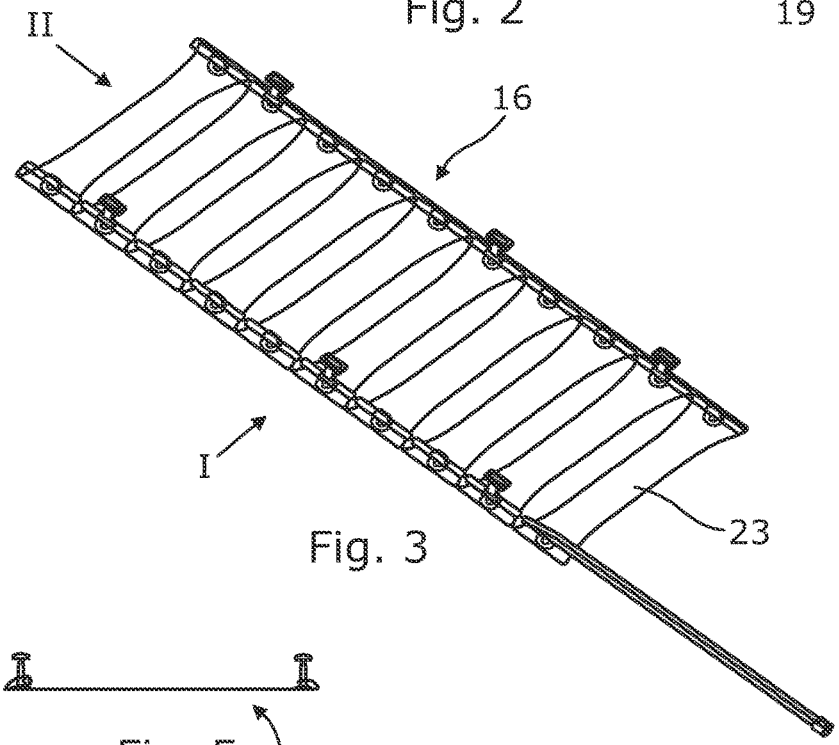
FIG. 3 is a view from below of the inlay of FIG. 2.
Figure 5:
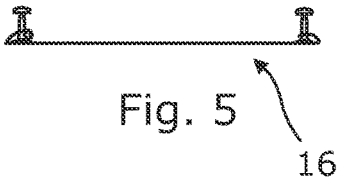
FIG. 5 is an end view taken along the arrow II in FIG. 3.
Figure 4:
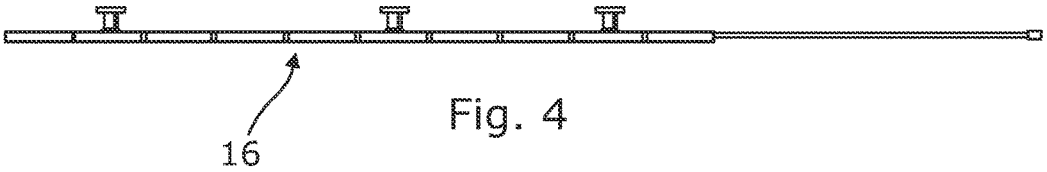
FIG. 4 is a side view taken on the arrow I.

Referring to FIG. 1, a hybrid pressure relieving mattress, generally indicated at 10, includes a tray 11, having a base 12 with a base surface 13 and side walls 14; a pressure relieving overlay 15 and an inflatable inlay 16. As will be explained in more detail in due course the inflatable inlay 16 has supply pipes, 18, 19 and 20. The base is formed with a first recess 21 and a second recess 22. The recesses 21, 22 run along the length of the base 13 and are dimensioned to receive the pipes 18 and 19 (in the case of recess 21) and 20 (in the case of recess 22), so that the pipes 18, 19 and 20 all lie below the base surface 13.

Aspects of the inlay will now be described with reference to FIGS. 2 to 12. The inlay 16 comprises a series of lateral cells 23 which are engaged, at their respective ends, around the supply pipe 20 and the supply pipes 18 and 19. As can best be seen in FIGS. 9 and 12, each element, in its un-inflated state, has ends 24 which are, wider laterally (in respect of the cell) than the intermediate middle portion 25.

Adjacent its respective ends, each cell 23 has a grommet sealed in its under surface. For reasons which will become clear below each cell has one grommet 26*a* which has an open recess at its centre defining a passage into the cell 23 and another grommet 26*b* which is sealed. Adjacent each grommet 26 is an anchor flap 27 which can form in a circle back to the adjacent grommet 26 so that the centre of the grommet 26 is aligned with an opening 28 in the anchor flap.

Figure 6:
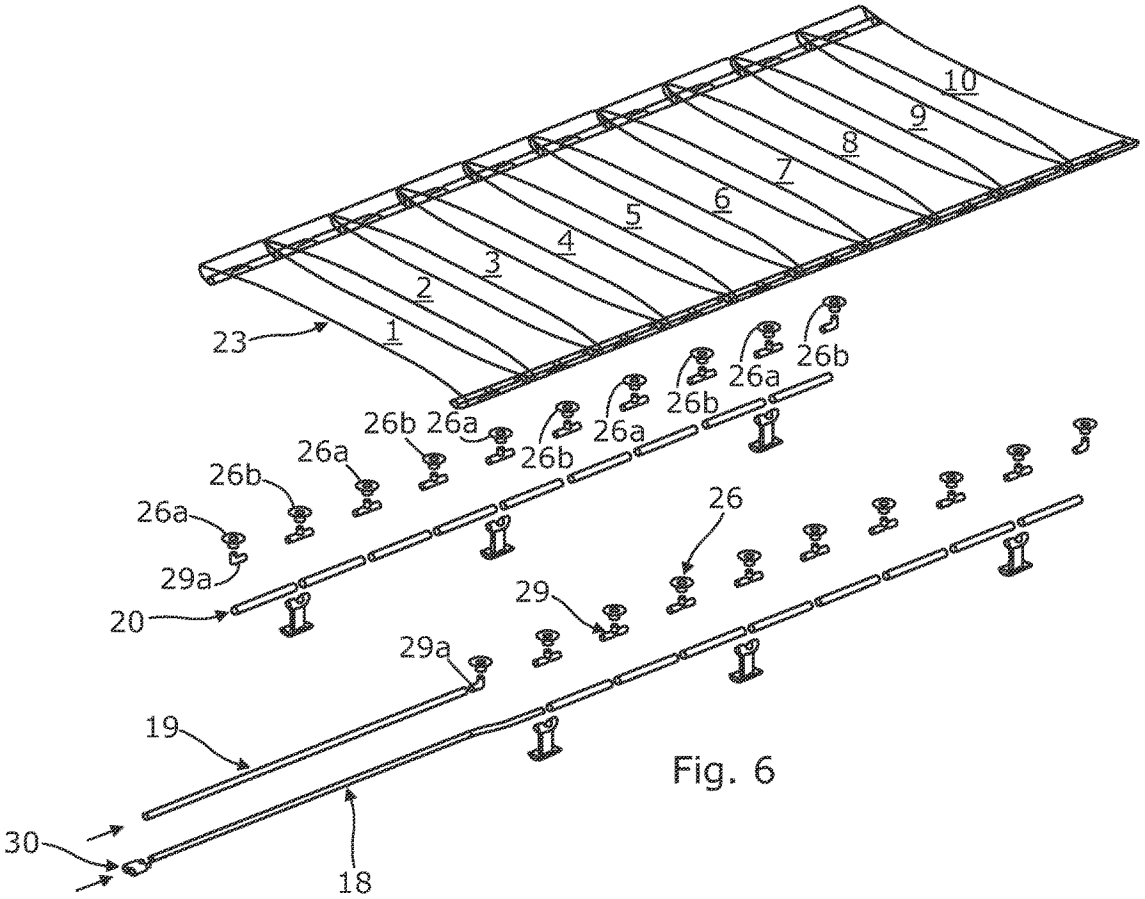
FIG. 6 is an exploded view taken from one end and the opposite side of FIG. 2.
Figure 8:
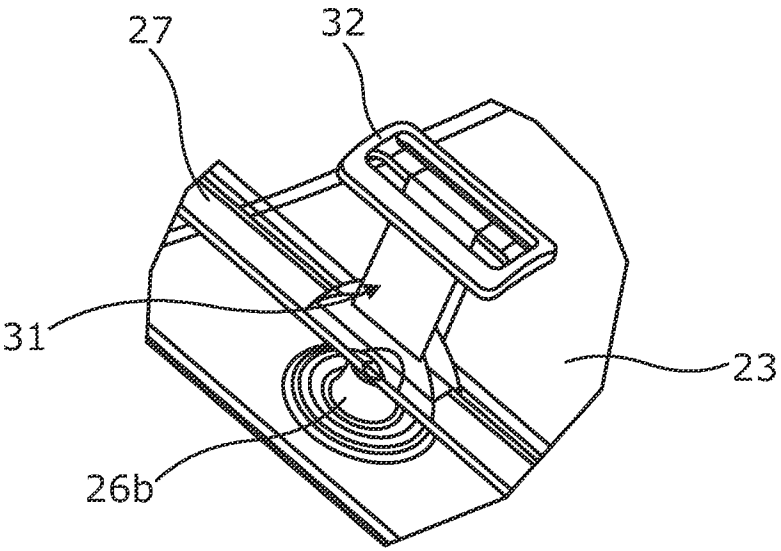
FIG. 8 is an enlarged detail of the portion circled B on FIG. 3.
Figure 7:
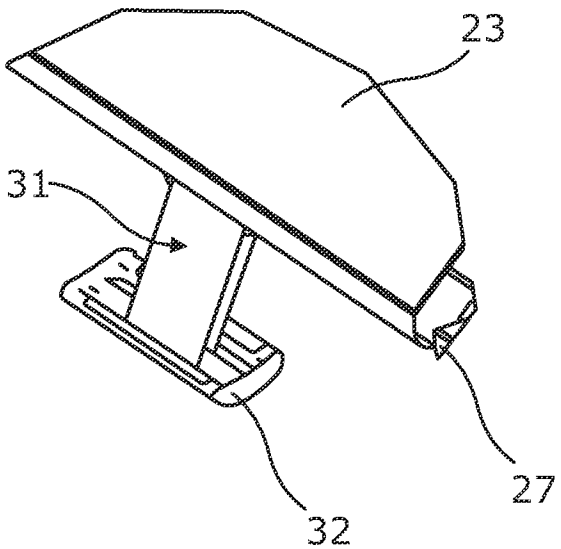
FIG. 7 is an enlarged detail of the portion of FIG. 2 circled A.
Figure 9:
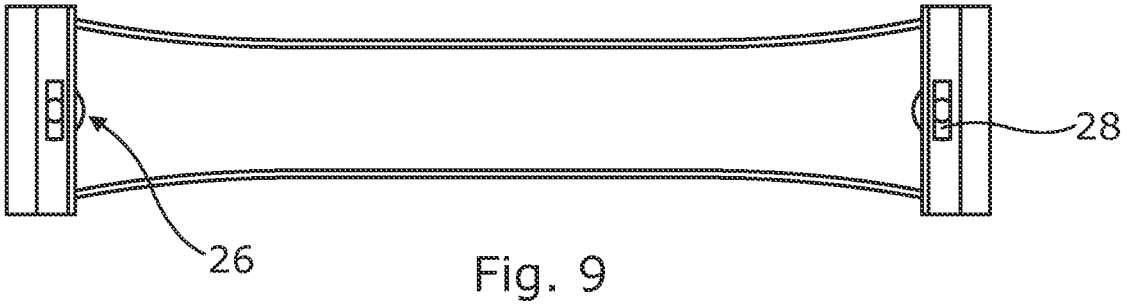
FIG. 9 is a view from below of an un-inflated element of the overlay.
Figure 10:
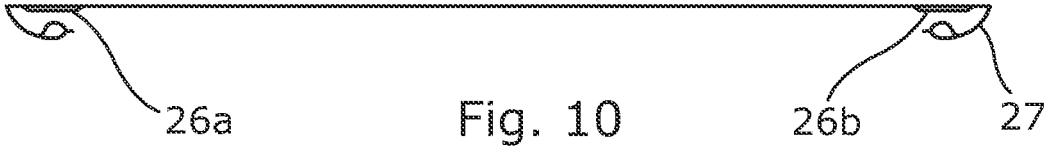
FIG. 10 is a side view of the element of FIG. 9.
Figure 11:
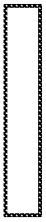
FIG. 11 is an end view of the element of FIG. 9.
Figure 12:
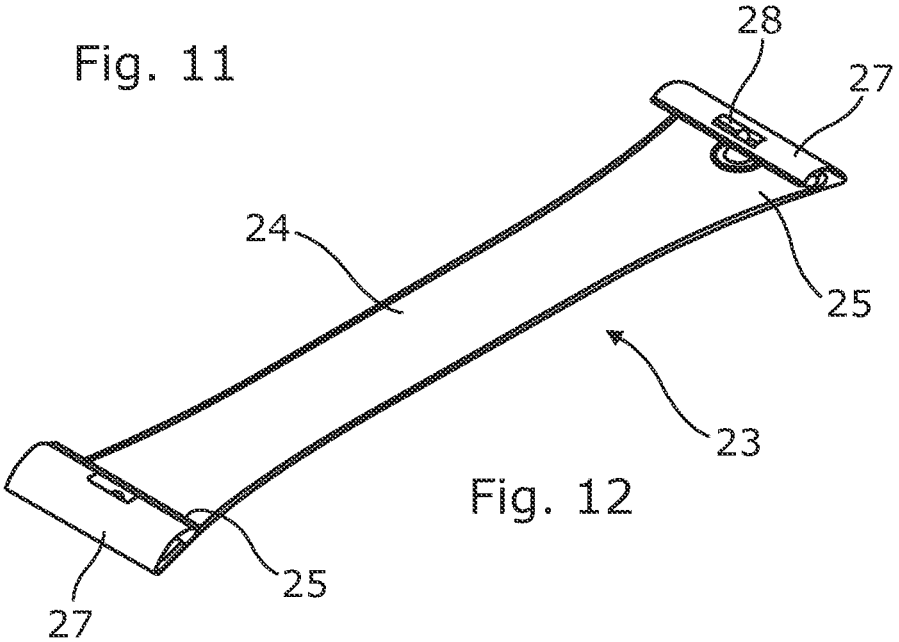
FIG. 12 is a perspective view of the element of FIG. 9 from one end and one side.

As can best be seen in FIG. 6 the supply pipes 18, 19 and 20 are made up of modular portions which can be interconnected by T or elbow connectors generally indicated at 29. The respective cells are engaged onto pipes 18 and 19 at one end and pipe 20 at the other end by encircling respective flaps 27 around the pipe or pipes and pushing the grommet down onto the adjacent connector 29. The cells 23 are arranged so that their grommets 26*a* and 26*b* alternate down a respective side of the inlay 16. Thus for example in the arrangement shown in FIG. 6 the left hand grommet of cell one is open (26*a*) whereas the left hand grommet (26*b*) of cell 2 is closed and so on alternately length of the inlay 16. The blanked off grommets of cells 1 and 10 are not illustrated in the exploded drawing.

In use, a pump (not shown) is connected to pipes 18 and 19 via a CPR release plug 30, which enables the whole mattress to be deflated extremely quickly in the event that resuscitation needs to take place on the mattress.

The pump (not shown) is a two phased pump so that, for example, air can initially be supplied to line 19 pass up elbow connector 29*a* through grommet along the cell 1 down through grommet 26*a* through elbow connector 29*b* into pipe 20. The air will then pass beneath closed grommet 26*b* in cell 2 to open grommet 26*a* in cell 3, which will be inflated and the air then passes back into line 18, bypasses cell 4, to inflate cell 5 and so on until cell 7 and 9 are inflated. The arrangement is set so that the inflation period is approximately five minutes. The pump (not shown) then switches into its second phase where the odd number cells are opened to atmosphere by the reverse path through which they were inflated and the even cells are inflated using line 18 and a similar path through the even cells. After another five minutes the cycle is begun again. In fact the cells do not fully deflate when open to atmosphere but they cease to be the main support for the patient. Thus the pressure applied to the patient's body is constantly changing.

In previous designs, there had been issues with the inlay "caterpillaring" up the mattress as a result of the alternate inflation and deflation of cells. To overcome this, ties 31 are provided, which attach to the anchor flaps 27, by means of a respective closed grommet 26*b* and the associated connector, and pass through openings (not shown) in the base 12 to be secured against the underside of the base by respective foot plates 32. The effect also serves to retain the pipes 18 to 20 in their respective recesses 21.

The invention claimed is:

1. A pressure relieving mattress comprising:

an elongate support having a base and a pair of spaced longitudinal side walls, the base providing a base surface extending between the side walls;

a pressure relieving overlay overlaying the base surface; and an inflatable inlay which extends between the base surface and the overlay, and which comprises a plurality of laterally extending inflatable cells that define an inflatable volume with a first end, a mid portion, and a second end, each cell comprising a grommet disposed at the first and second end thereof, one of the grommets being open to define a passage into the cell and the other grommet being closed, wherein adjacent cells comprise open and closed grommets at alternate ends thereof, and wherein at least one of the inflatable volumes is wider adjacent its ends than in its mid portion in an un-inflated state, the pressure relieving mattress further comprising a first supply extending longitudinally along the mattress within a first recess, below the base surface, and a second supply extending longitudinally along the mattress within a second recess, below the base surface, and which is separate from the first recess, the first and second supply supplying alternate cells of the plurality of laterally extending inflatable cells.

2. A pressure relieving mattress as claimed in claim 1 wherein the mid portion of at least one cell is narrower than the first end and the second end in an un-inflated state, and wherein when inflated, the cells define a substantially horizontal support platform.

3. A pressure relieving mattress as claimed in claim 1 wherein the inflatable volume of at least one cell is in the shape of a bow tie when in the un-inflated state.

4. A pressure relieving mattress as claimed in claim 1 wherein at least a portion of the first supply lies on an opposite side of the overlay than the second supply.

5. A pressure relieving mattress as claimed in claim 1, wherein the first recess and the second recess are on opposite sides of the base.

6. A pressure relieving mattress as claimed in claim 1 wherein each laterally extending inflatable cell has one or more anchor flaps for encircling a supply to secure the laterally extending inflatable cell.

7. A pressure relieving mattress as claimed in claim 6 wherein at least some anchor flaps have an associated passage for allowing air to pass from the supply to the laterally extending inflatable cell or to allow air to pass from the laterally extending inflatable cell to the supply.

8. A pressure relieving mattress as claimed in claim 1 further comprising a supply in fluid communication with at least one laterally extending inflatable cell, and a plurality of ties for securing the supply to the elongate support.

9. A pressure relieving mattress as claimed in claim 1 further comprising a supply made up of modular elements and in fluid communication with at least one laterally extending inflatable cell.

10. A pressure relieving mattress as claimed in claim 9, wherein the modular elements include T portions and connectors.

11. A pressure relieving mattress as claimed in claim 10 wherein an arm of at least some of the T portion engages a corresponding one of the laterally extending inflatable cells.

12. A pressure relieving mattress as claimed in claim 1 wherein the inflatable volumes are substantially the same width as the pressure relieving overlay.

* * * * *